United States Patent [19]

Goodrich

[11] 4,441,615

[45] Apr. 10, 1984

[54] STACKABLE TRAY

[76] Inventor: D. Stephen Goodrich, 4322 Fig Tree Woods, San Antonio, Tex. 78249

[21] Appl. No.: 428,194

[22] Filed: Sep. 29, 1982

[51] Int. Cl.[3] ..... B65D 21/02

[52] U.S. Cl. ..... 206/511; 206/505; 206/512; 211/126

[58] Field of Search ..... 206/505, 507, 509, 510, 206/511, 512; 248/126, 127, 128

[56] References Cited

U.S. PATENT DOCUMENTS

| | | | |
|---|---|---|---|
| 2,563,330 | 8/1951 | Gimbal | 206/511 |
| 2,566,500 | 9/1951 | Rose | 206/511 |
| 3,027,045 | 3/1962 | Wilson . | |
| 3,887,073 | 6/1975 | Wilson | 200/511 |
| 4,000,817 | 1/1977 | Sanders et al. . | |
| 4,102,453 | 7/1978 | Carroll et al. . | |
| 4,238,032 | 12/1982 | Thurman . | |
| 4,308,954 | 1/1982 | Wlson . | |
| 4,320,837 | 3/1982 | Carroll et al. . | |

FOREIGN PATENT DOCUMENTS

| | | | |
|---|---|---|---|
| 1253561 | 11/1971 | United Kingdom | 206/511 |

*Primary Examiner*—George E. Lowrance

[57] ABSTRACT

A stackable tray includes a generally planar tray bottom and a pair of opposed side walls extending upwardly therefrom. A pair of rails extend downwardly from the bottom and lie generally below the side walls. Ridges are provided at the bottom of the rails and slots and support edges are provided adjacent the side walls to permit the trays to be stacked in a variety of configurations. The H-design of the trays of the present invention improves stacking and stability characteristics.

10 Claims, 7 Drawing Figures

STACKABLE TRAY

BACKGROUND OF THE INVENTION

1. Field of the Invention

The present invention relates generally to the art of trays and in particular to stackable trays which may be used to contain, transport and display a variety of food and other products.

2. Description of the Prior Art

Various types of trays, baskets and tote boxes are commonly utilized to transport products at production facilities and to and from the distribution system. Such trays and baskets are especially common in the food industry. For example, bakeries use such trays to transport bread products to grocery stores. Produce distributors use them to transport produce, and butchers use them to transport portioned meat.

In the bakery industry, trays are typically used for transporting bread, and baskets are used for transporting buns, cakes, pastry, rolls, etc. The trays and baskets may be interchangeable, but as a rule, this only occurs when there is a temporary shortage of a specific tray or basket. These types of trays or baskets may be constructed of wire form, steel draw forms or molded plastic and are manufactured in a variety of sizes and heights to accommodate a wide variety of products. As a general rule, such trays and baskets may be stacked for reasons which will be discussed later in this specification.

Greater detail will now be provided concerning the trays and baskets used in the bakery industry. It should be understood at the outset, however, that such description is provided for purposes of illustration rather than for limitation. One skilled in the art could readily adapt the principles of the present invention to a wide variety of food and non-food items after reading the present specification. For example, many industrial applications exist where stackable trays may be used to convey parts or components from one part of a plant to another part of a plant or such stackable trays may be used to store completed parts or assemblies. Many of the problems encountered with prior art bakery trays and baskets are also encountered in such industrial applications, so the present invention will be equally applicable thereto.

Common bread trays are about 20–22 inches in width, 26–30 inches in length and are about 1–1.5 inches high. They are similar in many ways to common cafeteria type trays, with diverging front, rear and side walls to permit nesting (similar to the way paper cups nest). The baskets most commonly employed are constructed of wire and have measurements similar to bread trays but come in a variety of heights to accommodate the particular type of bakery product they are designed to hold, for example, between about $2\frac{1}{2}$–$5\frac{1}{2}$ inches. These wire-form baskets do not nest the way bread trays do, but instead they stack.

Bakery trays and baskets are employed in the manufacturing plant to contain and transport product on conveyor lines and in mobile carts known as halfracks. They are also used in automatic and manual handling systems at the shipping docks at the plant.

Halfracks usually hold about 28 trays or baskets and are loaded at the plant for subsequent delivery of the product to semi-trailers or delivery vans. Smaller vans and route trucks also typically have a halfrack arrangement, but these are not mobile. Instead, they are permanently mounted in the interior storage area of the truck or van. Such halfracks are generally quite heavy and their elimination would result in reduced fuel consumption and a consequent savings in product transportation cost.

Once the bakery trays or baskets leave the plant, they continue to be used in the transportation and product distribution system. Loaded halfracks are moved from a conveyor system onto the semi-trailers where they are delivered to route trucks. At this point the trays or baskets are loaded into the route trucks to transport the goods to wholesale or retail outlets. At the sales outlet, the trays or baskets are used to carry the product from the trucks to the display area and are frequently used for on-floor display. If not, the trays and baskets are unloaded and the empty trays are loaded back on the route trucks.

To fully appreciate the importance of the trays or baskets in the product distribution system, it is necessary to first understand that the business is one of extremely high volume, where cost and efficiency have a great impact on profitability. It is most advantegeous to load delivery trucks to maximum capacity. But it must also be remembered that the delivery trucks pick up return baskets or trays on a daily basis to feed them back into the product handling system. The logistics of the system can easily be upset as illustrated by the following example. If a fully loaded truck makes its first delivery and unloads ten trays or baskets, but finds twenty empty trays or baskets, an impossible situation exists unless the trays or baskets have some nesting capability. The random sequence of delivering loaded trays and picking up empty trays makes this problem one which is encountered on a daily basis.

Some commercially available trays have moving parts to provide a nesting capability. However, because trays and baskets are handled so frequently, such trays or baskets can easily become damaged. Plastic baskets are available with moving flaps to provide various stacking heights, but damage to one of the moving parts will render the entire tray unusable for its intended function. Further, some trays or baskets are available which achieve various stacking heights through rotation of the basket by 90° or 180°. The handling of such baskets requires additional time, thereby decreasing the overall efficiency of the distribution system.

Several of such trays are described in issued U.S. Letters Patents Wilson, in his U.S. Letters Pat. No. 4,308,954, issued Jan. 5, 1982 for "Plastic Nestable-Stackable Receptacle", describes a tray for bakery or other products which may be stacked without the need to slide or rotate the receptacles with respect to one another. The tray is generally U-shaped and includes a plurality of projections which extend upwardly from the top of the side walls and several rows of slots in the side walls and below the projections. The trays may be stacked one on top of the other or nested by inserting the projections of a lower tray into the slots of the upper tray. The height is selected by the row of slots chosen. This patent does not relate to baskets or trays which may be stacked or nested at more than two heights. Furthermore, the projections and slots can be damaged during use, preventing the nesting or stacking capability, and the alignment of projections with slots requires time which decreases distribution system efficiency.

Thurman, in his U.S. Letters Pat. No. 4,238,032, issued Dec. 9, 1980 for "Three-Position Stacking Tray", describes a tray which again is generally U-shaped and which includes a series of parallel but angled ribs on each of the tray's side walls. Each rib includes a notch on a side surface, approximately half way between the top and the bottom of the tray. The ribs of one side are also arranged in mirror relationship to the ribs on the other side. The three height capability is accomplished by reversing the trays 180° for one height and by the type of vertical movement employed when the trays are assembled. The reversal of tray orientation and manipulation in assembly (to ensure that the notches seat property) is time consuming and reduces the efficiency of distribution involving such trays.

Another multi-position container is described in the Carroll et al. U.S. Letters Pat. Nos. 4,102,453 and 4,320,837 issued respectively on July 25, 1978 and Mar. 23, 1982 for "Nesting and Stacking Containers." These patents also describe U-shaped trays which include features which permit the trays to be stacked in three positions without rotating one container with respect to another. This is accomplished by providing side walls having an upper rail and a plurality of bars extending along the outside of the side walls and inclined downwardly, each bar having a stacking foot formed on the bottom thereof. The top of each bar forms a stacking saddle. The angle of each bar is selected so that the foot of one bar can nest in the saddle of an adjacent bar to provide a high-nest stacking position. The lowermost stacking position is accomplished when the bars slide between one another. An intermediate position is made possible by providing stacking supports intermediate the ends of the bars which are cup-like supports and act like the saddles described above. A back wall of the tray also includes inclined bars to assist in the stacking. The Carroll device is quite complex and the inclined bars and various saddle supports are subject to damage rendering the trays useless. Furthermore, the alignment of the trays to obtain the desired stocking height is relatively time consuming.

Wilson describes a "Meat Lug" in U.S. Letters Pat. No. 3,027,045 issued Mar. 27, 1962 which is capable of being stacked at two levels. The lug has four ribs molded into its side walls and a pair of notches formed in the top surface of the lug on either side of the ribs. The lugs are nested by having the ribs slide into the ribs of a lower lug and are stacked by placing the bottom of the ribs of the upper tray into the notches of a lower tray. In the stacking positions, the lugs are alternatively placed in different ones of the pair of notches to maintain stability. The lugs cannot be stacked at three levels.

Finally, Sanders et al., in U.S. Letters Pat. No. 4,000,817 issued Jan. 4, 1977 describe a "Three Level Stacking Container" which includes stacking feet formed on an exterior tray wall and saddles on the top of the interior of the walls and at two levels for supporting the feet. The feet are generally L-shaped and the determination of the stacking level is established by the orientation of the trays. In addition, the trays must be tilted somewhat to accomplish insertion of the feet into the saddles. The Sanders et al. tray is also generally U-shaped.

A tray which overcomes the aforementioned disadvantage of the prior art would represent a significant advance in this art. Ideally, such a tray should nest at its lowest stacking height, should have at least three stacking heights, should allow for maximum product visability and accessability, should be stable when stacked, should be adaptable to current conveyor and product handling systems, should have durability, should have no moving parts and should be as light in weight as possible.

OBJECTS AND SUMMARY OF THE INVENTION

It is a primary object of the present invention to provide a tray or basket which overcomes the aforementioned disadvantages of the prior art and which satisfies the requirements for an improved tray set forth above.

Another object of the present invention is to provide a tray having three stacking heights including a nesting capability.

Yet another object of the present invention is to provide a tray which is light in weight and durable and which will function with minor damage.

Still another object of the present invention is to provide a tray which has an H-design and which allows maximum product visibility and accessability.

A different object of the present invention is to provide a tray having no moving parts and which can be easily and quickly stacked into any of its stacking configurations.

Another object of the present invention is to provide a tray which is compatible with current conveyor, transportation and product distribution systems.

How these and other objects of the invention are accomplished will be described in the following specification, taken in conjunction with the drawings. Generally, however, the objects are accomplished by a tray having an H-design rather than the U-design described above in connection with the prior art. In the preferred embodiment, the tray has a planar product supporting surface and side walls extending upwardly therefrom. Lower walls extend downwardly from the support surface below the side walls. The lower walls include a notched edge which is adapted to rest on the top of the side walls of the lower tray to provide a high stack capability. The tray of the preferred embodiment of the present invention also includes support edges adjacent the side walls and first slots to support the rails in an intermediate stack position, and second slots are also provided adjacent the side walls to receive the rails and provide a nesting position. Further variations of the invention will be described in the specification.

DESCRIPTION OF THE PREFERRED EMBODIMENT

Figure 1:
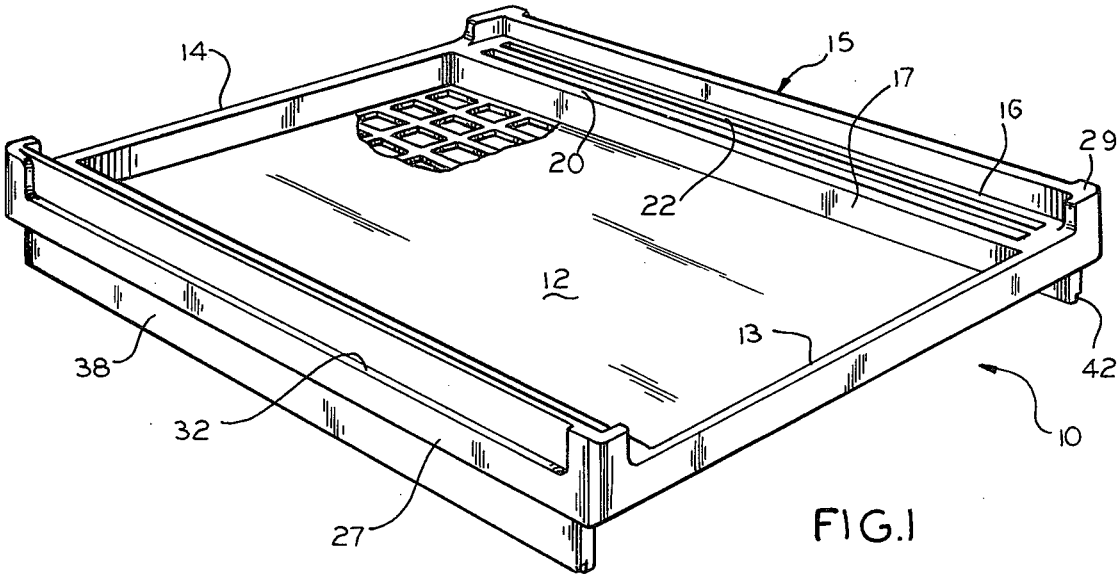
FIG. 1 is a perspective view of a tray according to the preferred embodiment of the present invention.
Figure 2:
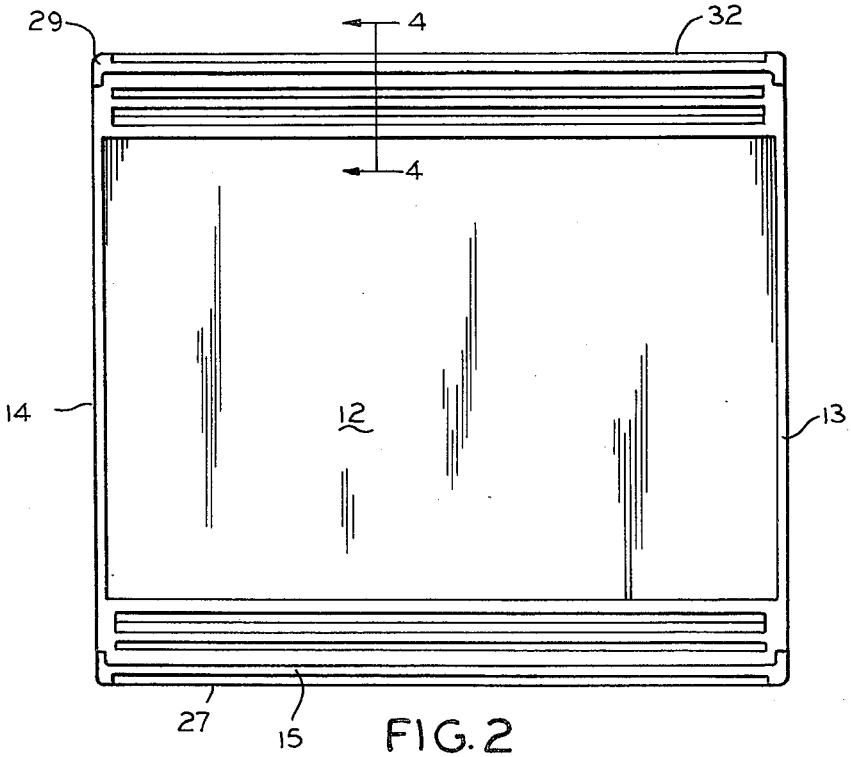
FIG. 2 is a top plan view of the tray according to the preferred embodiment of the present invention.

The tray 10 according to the preferred embodiment of the present invention includes a generally planar product support surface 12 which may be square or rectangular or may be of any other desired shape. The drawings show the surface 12 to be continuous, but it will be obvious to one skilled in the art that surface 12 may have holes, slots or other openings for weight reduction or aesthetic purposes (as illustrated at 13 in FIG. 1). It should also be stated at the outset that in the preferred embodiment, tray 10 is preferably a unitary structure which may be molded from plastic or foamed plastic. The invention should not be limited thereto as one skilled in the art could readily select other construction techniques or materials for preparing tray 10.

Tray 10 includes front wall 13 and rear wall 14 which preferably are low in height to increase product visiibility and accessability. These walls extend upwardly from surface 12 and may be continuous or may include openings as described above. Side walls 15 are also provided. They are higher than walls 13 and 14 and are separated from product support surface 12 by a generally rectangular portion 16 which extends along the inside of each of side walls 15. Portion 16 includes an inner edge 17 having a height similar to the front and back walls, edges 17 together with the front wall 13 and back wall 14 defining the product holding area of tray 10. Portion 16 also includes a pair of elongate slots 20 and 22 which are parallel to side walls 15. Slot 20 is wider than slot 22 and preferably has an open bottom for a reason which will soon become apparent. The purpose of the slots and the precise arrangement thereof will become apparent later in the specification.

Outside the slots 20 and 22, the side walls 15 extend vertically upward from portion 16. The side walls 15 are inset slightly from the outer edges 27 of tray 10. Side walls 15 terminate in rounded corners 29. The top of corners 29 and side walls 15 define a plane which is parallel to and above the planes established by the top of portions 16 and by product support surface 12.

A horizontal support edge 32 is formed between the outside of side walls 15 and the side edges 27. Surface 32 is at a level which is slightly below the level of the top of portions 16 and thus the two horizontal edges 32 lie in a plane which is parallel to and intermediate those planes established by support surface 12 and the tops of portions 16.

The final components of tray 12 are a pair of lower walls 38 which extend downwardly from support surface 12 along the sides of tray 10. The outer surface of rails lie in the same vertical plane as the outside surface of side walls 15, while the inside surface of the lower walls each lie in a vertical plane which is inside but parallel to the plane of the inside surface of side walls 15. Furthermore, a foot 42 is formed at the bottom of lower walls 38 which extends along its length and is formed by an L-shaped notch having a vertical outward facing surface 45 and a horizontal downward facing surface 47. The lower walls 38 extend generally from front to back, but are shorter than the tray, beginning and ending inwardly of the corners 29.

Figure 4:
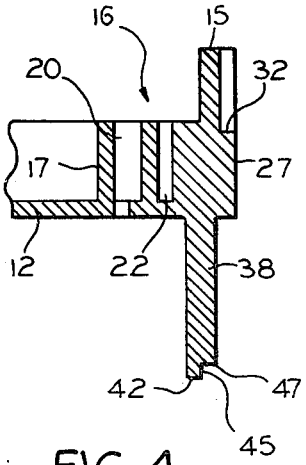
FIG. 4 is a side sectional view taken along the line 4—4 of FIG. 2.
Figure 3:
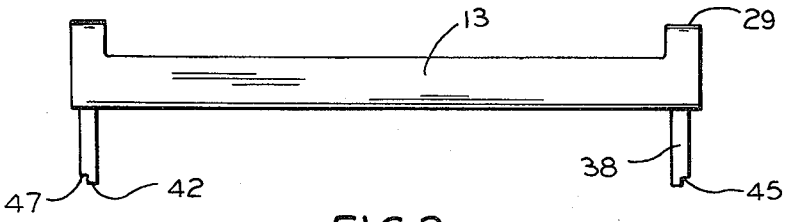
FIG. 3 is a front elevation view of the tray according to the preferred embodiment of the present invention.

The spatial relationship of the slots and various side wall and lower wall components can be appreciated best by reference to FIG. 4 (a cross-section through the side wall), but it should be understood that the various dimensional relationships can be varied to accommodate various types of products and various of the aforementioned design criteria without departing from the intended scope of the invention.

Now that the major components of tray 10 have been described, it is appropriate to describe the stacking capabilities thereof and then to describe variations which are deemed to fall within the scope of the present invention. Tray 10 may, of course, be used by itself with product supported on surface 12. The product is clearly visible because of the low front and back walls and the tray 10 can easily be handled because support surface 12 is elevated above the surface on which the tray rests.

Figure 5:
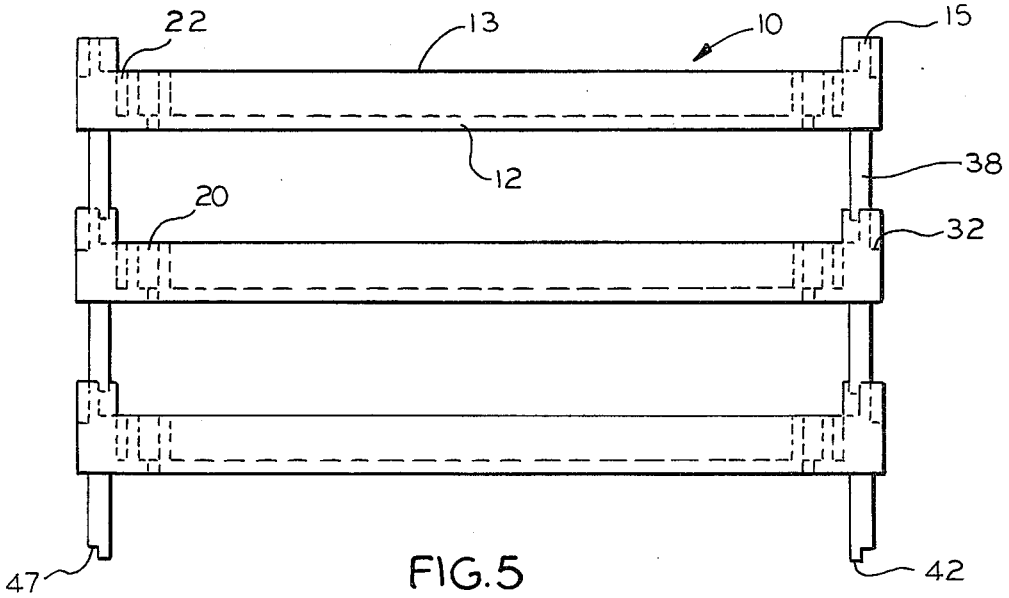
FIG. 5 is a cross-section of three trays according to the preferred embodiment of the present invention showing the trays in a high stack position.

It will be more common, however, for tray 10 to be used with other like trays, whether such use be in the factory, in the transportation and distribution system or in the store. For products which exceed the height of the side walls 15, but which do not exceed in height the overall height of tray 10, a high stacking mode is employed. In this mode, a tray 10 is lowered directly onto another tray so that the downwardly facing surfaces 47 of the rails 38 rest on the top of side walls 15 as shown in FIG. 5. This high stack position can accommodate a wide variety of products such as bread, rolls, cakes, etc.

Figure 6:
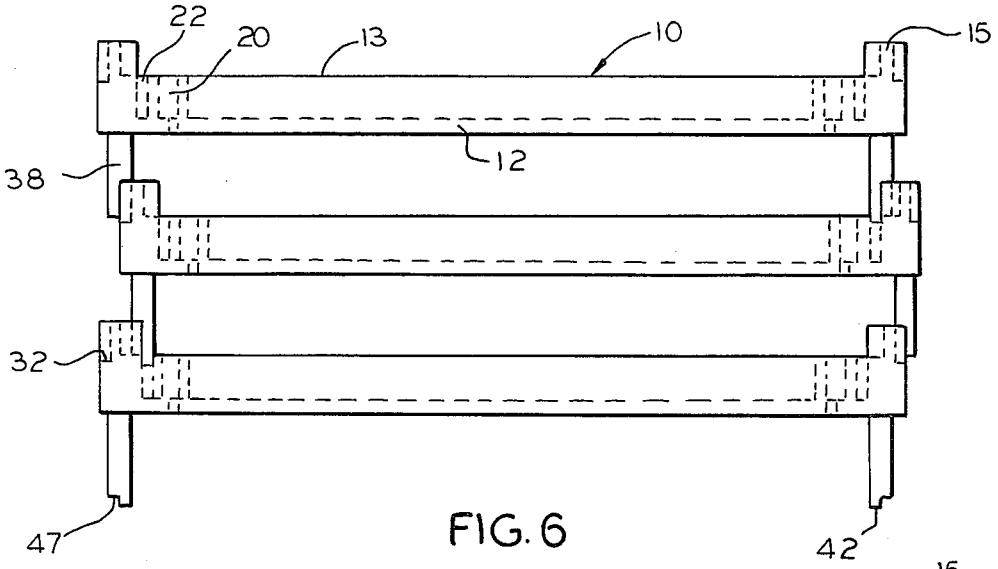
FIG. 6 is a cross-section of three trays according to the preferred embodiment of the present invention showing the trays in an intermediate stack position; and, FIG. 7 is a cross-section of three trays according to the preferred embodiment of the present invention and showing the trays in a low-stack or nesting configuration.

A second and intermediate stacking height is employed for shorter products such as pies, muffins, etc. This position is accomplished by again lowering one tray 10 onto another tray, but with a small lateral displacement. The front and back walls of tray 10 remain coplanar with the corresponding components of the lower tray during this maneuver. By reference to FIG. 6, it will be appreciated that one foot 42 of one tray will be secured in slot 22 of the lower tray while surface 47 of the other foot of the upper tray will be supported on side edge support surface 32. It should also be appreciated from FIG. 6 that the right to left movement to accomplish the intermediate stack height should be alternated as stacking progress to maintain balance and stability.

Figure 7:
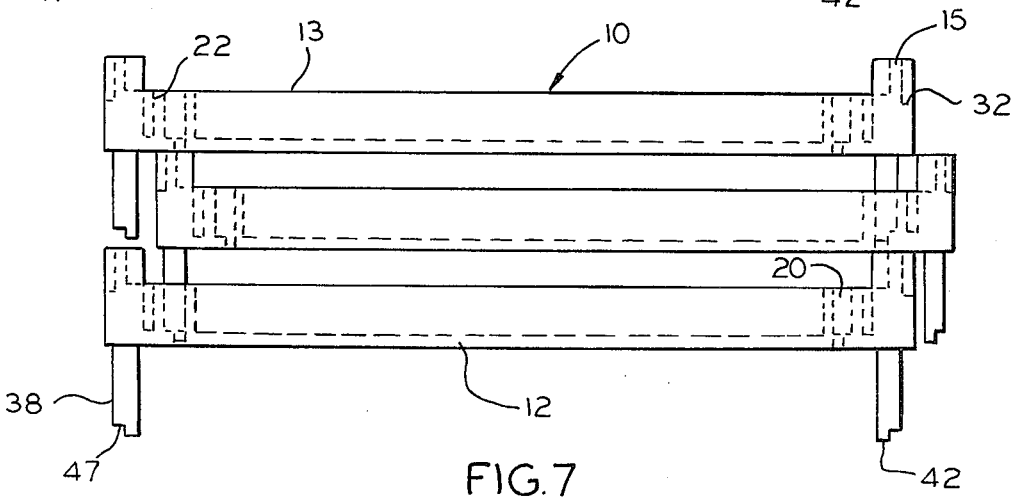

The lowermost stack height or nesting configuration is accomplished similarly to the procedure just described and is illustrated in FIG. 7. Here the right to left movement is increased slightly so that one wall 58 of the upper tray is dropped into a slot 20 of the lower tray. In this configuration, support for the opposite side of the tray is provided by the bottom of support surface 12 resting on the top of side wall 15 of the lower tray. Again for purposes of the improving stacking stability, the movements right and left should be alternated as shown in this figure.

It should also be understood that with tray 10 a mix of stacking heights can also be accomplished by varying the amount of lateral movement as the trays are assembled, i.e. the nest height can be used for some trays, while high and/or intermediate stacking is employed for others. There are no moving parts and no need for adjusting parts to allow stackability. The unique H-design of trays 10 permits stacking of 20 or more trays, and in all configurations, the trays are interlocked in such a way that they can move neither right or left nor forward or backwards, whether the trays are loaded or unloaded. Disengagement is accomplished simply by lifting the upper tray from engagement with its supporting tray.

Numerous variations of the present invention may be made without departing from its basic principles. For example, holes may be provided in feet 42 to receive wheels so that a stack of trays may be rolled from one location to another. The lower walls or side walls may be segmented for further weight reduction. So while the present invention has been described by reference to a particular preferred embodiment, it is not to be so limited but is to be limited solely by the claims which follow:

I claim:

1. A stackable tray comprising a generally planar product supporting surface having parallel sides, side walls extending upwardly and perpendicularly from said parallel sides of said product supporting surface, lower walls extending downwardly and perpendicularly from said supporting surface and generally below said side walls, the lower portion of said lower walls having a width less than the width of the remainder of said lower walls, first and second planar tray support surfaces extending horizontally and perpendicularly from both sides of said side walls, said first planar tray support surfaces extending outwardly from said side walls and said second planar tray support surfaces extending inwardly therefrom, said second planar tray support surfaces defining a plane above and parallel to said product support surface and each of said second planar tray support surface having a pair of slots therein, said slots being parallel to one another and to said side walls, a first one of said slots having a width exceeding the width of said lower walls and the second of said slots having a width less than the width of said lower walls, but greater than the width of said lower portion thereof.

2. The invention set forth in claim 1 wherein said first planar tray support surfaces lie in a plane which is above that defined by said second planar tray support surfaces and below that defined by the top of said side walls.

3. The invention set forth in claim 1 wherein said first slots are located closer to said side walls than said second slot.

4. The invention set forth in claim 1 wherein said lower portion of said lower walls is formed by an L-shaped notch extending along the bottom of said lower walls whereby said lower walls have a flat bottom and a horizontal edge lying in a plane parallel thereto.

5. The invention set forth in claim 1 wherein said product support surface is defined by two pair of parallel sides and wherein front and back walls extend upwardly and perpendicular from one pair of said sides.

6. The invention set forth in claim 5 wherein said front and back walls are shorter than said side walls.

7. A tray, which in combination with other such trays, may be stacked to three different stacking heights, said tray comprising:

a planar surface having parallel front and back walls extending perpendicularly therefrom and having a pair of parallel side walls extending perpendicularly therefrom to form a container for products;

first tray support surfaces extending along the outside of each of said side wall and said first tray support surfaces lying in a plane which is below the top of said side walls and which is parallel to said planar surface;

second tray support surfaces extending internally from each of said side walls and lying in a plane which is below that defined by said first tray support surfaces but above that defined by said planar surface;

first and second parallel slot means in each of said second tray support surfaces and extending parallel to said side walls, said first slots being nearer said side walls and being thinner than said second slots;

a pair of lower walls extending perpendicularly from said planar surface and generally below said side walls, said lower walls having a width which is less than the width of said second slots but greater than that of said first slots and having bottom edges having a width less than that of said first slots, a downwardly facing support surface being provided on each of said bottom walls at a location above said bottom edges, said downwardly facing support surfaces lying directly beneath the top of said side walls; whereby said tray may be stacked on an identical tray in three stacking heights depending on the lateral position of one tray relative to the next lower tray as follows:

(i) a high stack height wherein the downwardly facing support surfaces of an upper tray rest on the top of the side walls of the next lower tray;

(ii) an intermediate stack height wherein the downwardly facing support surfaces of an upper tray rest respectively on one of the first tray support surfaces and adjacent one of the said first slots of the next lower tray, the bottom edge of one of said lower walls being received in said first slot; and, (iii) a low stack height whereby one of the lower walls of an upper tray is received in one of the second slots of the next lower tray.

8. The invention set forth in claim 7 wherein said tray is constructed of plastic.

9. The invention set forth in claim 7 wherein said tray is constructed of foamed plastic.

10. The invention set forth in claim 7 wherein at least a portion of said tray includes openings therethrough whereby the overall weight of said tray is reduced.

* * * * *